US005206658A

United States Patent [19]

Wokurka

[11] Patent Number: 5,206,658

[45] Date of Patent: Apr. 27, 1993

[54] MULTIPLE BEAM ANTENNA SYSTEM

[75] Inventor: John Wokurka, Santa Ana, Calif.

[73] Assignee: Rockwell International Corporation, Seal Beach, Calif.

[21] Appl. No.: 607,389

[22] Filed: Oct. 31, 1990

[51] Int. Cl.[5] ..... H01Q 19/19

[52] U.S. Cl. ..... 343/755; 343/753; 343/781 R

[58] Field of Search ..... 343/753, 754, 755, 776, 343/781 R, 779, 911 R

[56] References Cited

U.S. PATENT DOCUMENTS

| | | | |
|---|---|---|---|
| 3,396,397 | 8/1968 | Kott | 343/754 |
| 3,430,244 | 11/1964 | Bartlett et al. | 343/755 |
| 3,911,440 | 10/1975 | Mizusawa | 343/755 |
| 4,254,421 | 3/1981 | Kreutel | 343/754 |
| 4,270,129 | 5/1981 | Herper et al. | 343/753 |
| 4,435,714 | 3/1984 | Luh | 343/753 |
| 4,503,434 | 3/1985 | Luh | 343/779 |

FOREIGN PATENT DOCUMENTS

| | | | |
|---|---|---|---|
| 0056704 | 4/1980 | Japan | 343/755 |

OTHER PUBLICATIONS

"Antenna Handbook: Theory, Applications, and Design", Lo et al, Van Nostrand Reinhold Company, pp. 16-33 to 16-38.

"A Feed Cluster Image Reduction System", Digest, J. Wokurka, IEEE AP-S Symposium, Blacksburg, Va. Jun. 1987, pp. 199-202.

*Primary Examiner*—Michael C. Wimer
*Assistant Examiner*—Tan Ho
*Attorney, Agent, or Firm*—David J. Arthur; Lawrence N. Ginsberg; Charles T. Silberberg

[57] ABSTRACT

A multiple beam antenna system may be constructed for reducing a spillover loss n efficiency, improving beam crossover, and reducing undesired sidelobes by the addition of three dielectric lenses between a feed horn cluster connected to a beam forming network and an objective collimator. The system includes a beam forming network including a plurality of feed horns in a feed horn cluster, an objective, and an imaging lens having a lateral magnification less than unity for focusing a reduced image of the feed horn cluster at a predetermined point in space. A field lens is positioned at that predetermined point in space, and an amplitude shaping lens is positioned between the field lens and the objective. The amplitude shaping lens redirects the rays of the image transmitted by the field lens to be denser in the central region of the objective, and reduce the sidelobes of the far field pattern of the transmitted beams.

9 Claims, 4 Drawing Sheets

MULTIPLE BEAM ANTENNA SYSTEM

BACKGROUND OF THE INVENTION

The present invention relates to multiple beam antenna (MBA) systems, such as are useful for communication satellites. Specifically, the present invention provides a microwave multiple beam antenna system that simultaneously achieves closely spaced beams (high crossover levels) and high aperture efficiency (low spillover loss) with a relatively simple beam forming network.

Conventional MBA designs, typically for communication satellites, place the feed horn cluster of the antenna at the focal point of an offset reflector collimator, as shown in FIG. 1. The feed horns are designed to be relatively small for close packaging in the cluster to give reasonably high crossover levels (i.e., closely spaced beams). A small feed horn, however, produces a broad radiation pattern for illuminating the offset reflector. This results in much of the energy not being intercepted by the reflector, and gives rise to high spillover loss. On the other hand, if the feed horns are designed for more directive beams to reduce the spillover loss, the feed horns become larger, yielding wider beam separation, and thus lower crossover levels. The result s "holes" in the pattern coverage.

FIG. 1 illustrates a conventional multiple beam antenna configuration. A beam forming network (BFN) 11 supplies signals to a feed horn cluster 13. which illuminates an offset paraboloid reflector 15. If the feed horns 19 are made relatively small for close packaging and reasonably high crossover levels 17 (as shown in FIG. 2), a significant portion of the beam misses the reflector, becoming spillover loss 21. Alternative feed horns that produce more directive beams to reduce the spillover loss, produce low beam crossover levels 23 in the beams reflected from the offset paraboloid reflector, as shown in FIG. 3.

A partial solution to the spillover loss problem is described by the inventor in Wokurka, A Feed Cluster Image Reduction System, Digest, IEEE AP-S Symposium, Blacksburg, Virginia, Jun. 1987, pages 199–202. In the system there described, an "imaging" lens is used to produce an optically reduced image of a large feed horn cluster. The reduced image of the feed horns is then used to illuminate the collimating reflector or dielectric lens. A field lens is placed between the imaging lens and the objective lens to efficiently refract the energy from each feed horn onto the objective lens, thereby maintaining low spillover loss for each beam at the objective lens.

Another system that has been suggested is to form overlapping feed horn subclusters with a more complex beam forming network. With this approach, energy to be radiated in a beam is divided in the BFN and applied to several adjacent horns. This approach increases the feed aperture size, and narrows the feed radiation pattern, to more efficiently illuminate the reflector. Adjacent beams are produced by overlapping these clustered feed horns. However, this approach complicates the feed network greatly, particularly for millimeter wave length signals and/or systems using a large number of beams. This approach also adds significantly to waveguide or transmission line losses. Such increased complexity and losses are particularly pronounced at higher millimeter wave frequencies, where they are least tolerable.

Another proposed solution to the spillover loss problem is to build several antennas, each of which produces widely spaced beams that are a portion of the total required. The beams from the separate antennas are then interlaced in space to create the full coverage complement. Clearly, this approach adds much unnecessary weight and volume to the antenna system by adding more antennas.

SUMMARY OF THE INVENTION

The present invention is a multiple beam antenna system that includes a beam forming network that includes a plurality of feed horns in a feed horn cluster and objective. An imaging lens having a lateral magnification less than one for focusing a reduced image of the feed horn cluster at a predetermined point in space is placed next to the horn cluster. A field lens is positioned at that predetermined point in space, and an amplitude shaping lens is positioned between the field lens and the objective. The amplitude shaping lens redirects the rays of the image transmitted by the field lens to be denser in the central region of the objective and consequently reduces the sidelobes in the far field pattern of the transmitted beam.

DETAILED DESCRIPTION OF THE PREFERRED EMBODIMENT

Figure 1:
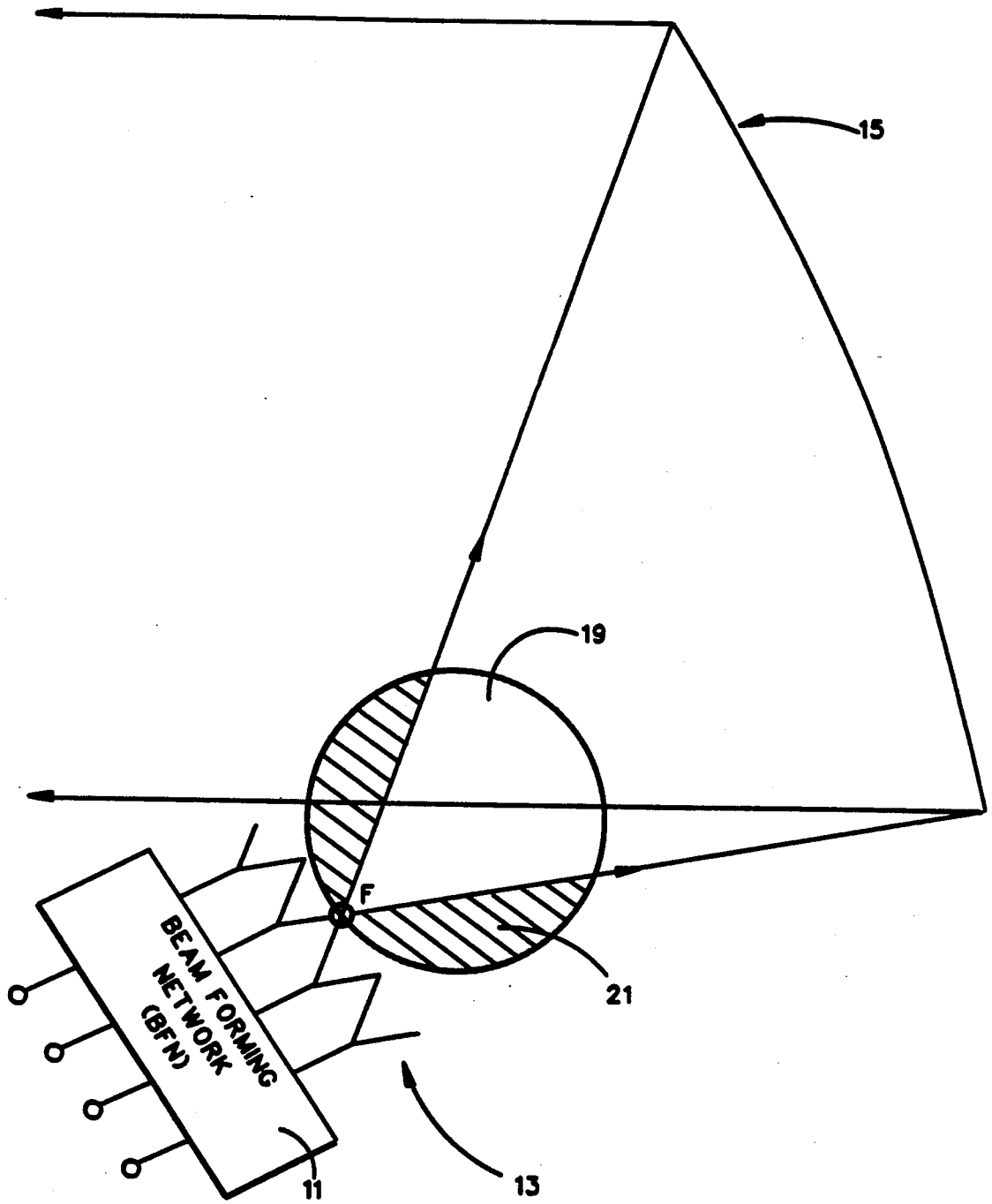
FIG. 1 shows a conventional multiple beam antenna system.
Figure 2:
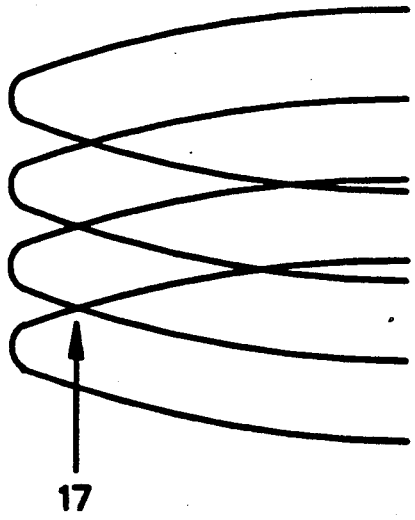
FIG. 2 shows beams having high crossover levels.
Figure 3:
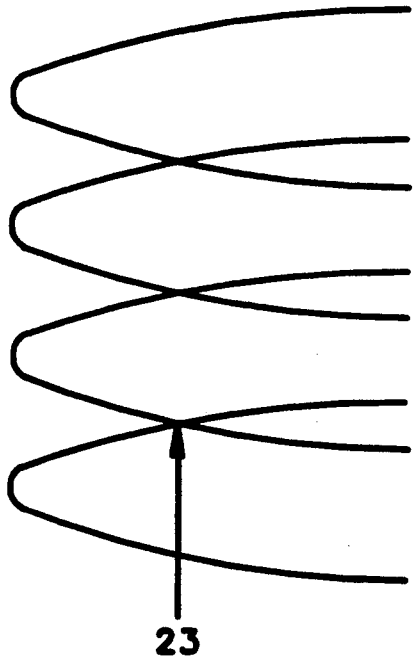
FIG. 3 shows beams having low crossover levels.

In the present invention, spillover loss from individual microwave horns in a feed horn cluster used in conventional multiple beam antenna designs is reduced by the placement of three dielectric lenses between the feed cluster and the final collimating reflector or lens.

The present invention incorporates a beam forming network 31, which may be of the type generally known and understood in the industry. This beam forming network transmits beams through a feed horn cluster 33. Such feed horn clusters and their attributes are also well understood in the art.

An imaging lens 35 is placed in the path of the beams 37 from the feed horn cluster. This imaging lens 35 has a lateral magnification of less than unity, so that an optically-reduced image of the feed horn cluster is produced at the field lens 43. The imaging lens can be shaped and positioned so that a minimum portion of the beams 37 produced by the feed horn cluster bypass the lens. This provides minimum spillover loss 39 from the feed horn cluster.

The imaging lens 35 focuses the reduced image of the feed horns at a point in space. The reduced feed horn image can be used to illuminate an offset reflector 41. In the embodiment illustrated in FIG. 4, the objective 41 is an offset paraboloid reflector. Alternatively, a lens may function as the objective.

The field lens 43 is placed at the feed horn image to efficiently refract the energy from each feed horn of the feed horn cluster onto the objective reflector 41. By properly refracting the beams from the optically reduced image of the feed horn cluster, a maximum of the beams 45 impact the objective reflector 41, providing minimal spillover loss 47.

The imaging lens 35 forms overlapped and clustered feed distributions optically in space at the field lens plane, so that the image formed at the field lens is a small overlapped replica of the physically larger real cluster. The imaging lens may provide a 0.5 lateral magnification (or image reduction) factor of the actual feed horn cluster. Focusing the reduced image of the feed horn cluster at the field lens 43 causes the energy to appear to the objective reflector 41 as though it were coming from a more closely spaced feed horn cluster, with correspondingly closer horn phase centers.

By using larger feed horns, with their associated more directive patterns as the elements of the feed cluster, and optically reducing the size of this cluster with the imaging dielectric lens, spillover loss is reduced. The feed horn amplitude taper at the imaging lens edge can be made to be −10dB, resulting in low spillover loss 39 at the imaging lens.

The radiated beams are therefore spaced more closely in space, resulting in higher beam crossovers. A given crossover level can be realized by properly choosing the lateral magnification of the imaging lens during the design of the system. A higher beam crossover level results in a higher minimum gain of the composite antenna gain coverage.

With a uniform amplitude or power density distribution across the objective 41, the collimated beams 49 reflected from the reflector 41 may contain significant sidelobes in the far field pattern due to beam diffraction. To reduce the sidelobes in the far field pattern, an amplitude shaping lens 51 redirects more of the energy rays in the central part of the reflector. Thus, the amplitude shaping lens alters the "ray bunching" or power density distribution so that the rays of energy from the antenna horns are denser in the central region of the system. The amplitude shaping lens concentrates the power of the beams in the central part of the collimating reflector, giving rise to low sidelobe reflected beams 49. Increasing the power density in the central portion of the beam pattern reduces beam diffraction and the associated sidelobes in the beam pattern.

Amplitude shaping is accomplished primarily through refraction at the first surface of the amplitude shaping lens 51. The second surface is contoured mainly to satisfy the phase constraint. Ordinarily, the chosen shape of the lens is sensitive to the central thickness of the lens and the distance from the field lens 43 to the amplitude shaping lens 51, and the central thickness of the amplitude shaping lens. Some amplitude shaping can be done by the objective reflector lens 41. However, such shaping by the objective would likely be at odds with the wide-angle "scanning" requirement for the multiple beams of a multiple beam antenna system.

Equations for the paraxial rays (those close to the axis that satisfy the small angle approximation) for each lens may be derived, depending on the lens material, its dielectric constant, and the lens thickness. Geometrical optics computer programs can be used to trace rays through the different lenses of the system and determine the aspheric term coefficients specifying the surface away from the central axis. A scalar defraction theory computer program can be used to determine the amplitude and phase distributions on each lens surface and calculate the far field radiation patterns.

The geometrical optics program can be used to successively determine higher order coefficients of the lens surface expressions to focus, with the imaging lens, the non-paraxial rays at the focused spot images of each feed horn in the field lens plane. This helps to insure that the non-paraxial rays are not spilled over, but rather fall on the objective reflector for each feed horn to realize high aperture efficiency. Additionally, the surface coefficients of the objective reflector or objective lens can be determined to ensure a low phase error distribution (preferably 50 degrees maximum) across the aperture for each beam.

The lenses for a system for 44 GHz wavelengths may be fabricated of a dielectric material, such as alumina having a dielectric constant of 9.72. The center of each lens may be approximately one inch thick. The amplitude shaping lens 51 in particular should have a center of sufficient thickness to ensure that enough dielectric medium is present at the outer rim of the lens for the rays to converge and perform the power transformation required.

For such a system for 44 GHz wavelengths, the distance from the edge of the feed horns to the objective reflector or the far surface of an objective lens may be approximately 32.2 inches. The lenses may be installed in an eight inch diameter stainless steel machined tube. The position of the imaging lens 35 may be fixed, while the field lens 43, amplitude shaping lens 51, and objective lens 53 or reflector 41 may have adjustable positions.

The present invention also increases the "hardness" of the system to electromagnetic and particle beam threats by virtue of the hard lens material shielding the feed horns and the sensitive receivers connected to the antenna feed network ports. The lens surface could also be made reflective or diffuse at other threat frequencies, such as in the laser optical spectrum.

The present invention allows the final objective aperture distribution to be phase corrected by adjusting higher order coefficients in the lens surface equations so as to improve beam distortion resulting from feeds progressively farther from the feed cluster access of symmetry.

Figure 4:
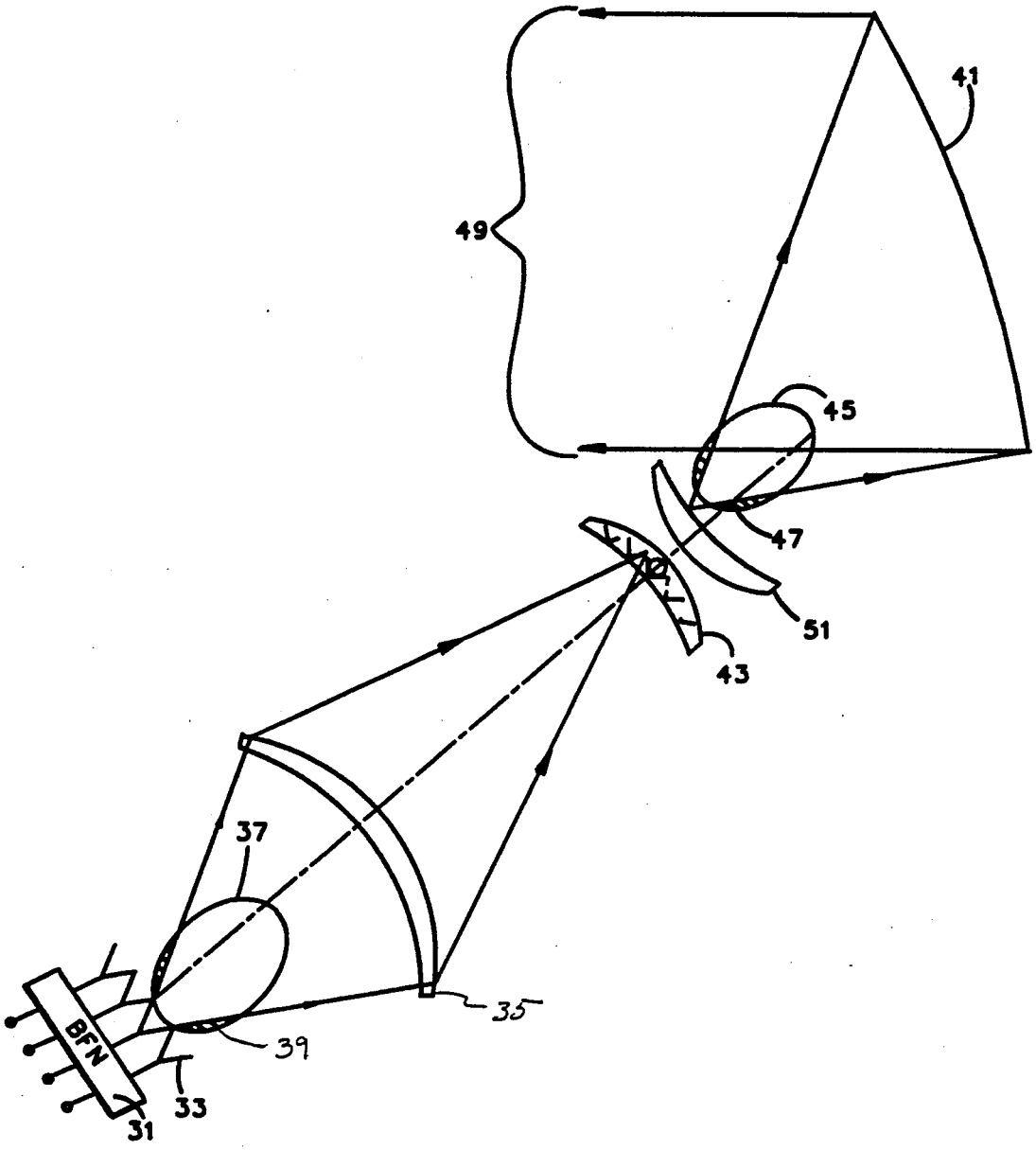
FIG. 4 illustrates one embodiment of the multiple beam antenna system of the invention.
Figure 5:
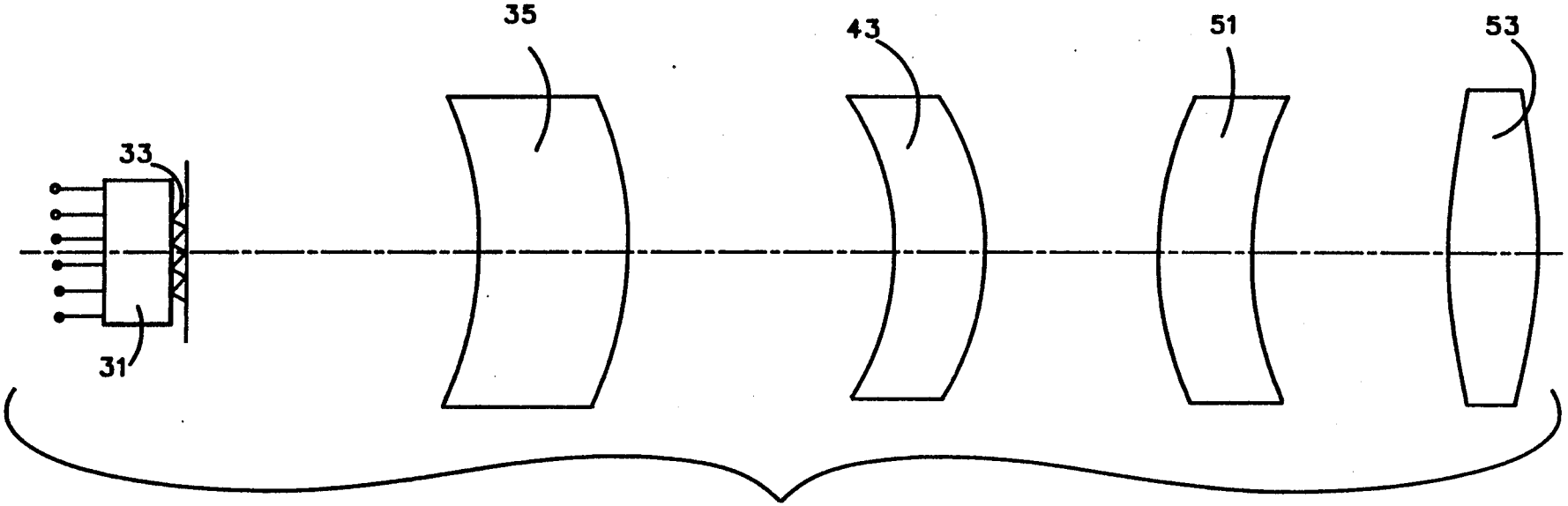
FIG. 5 illustrates an alternative embodiment of the invention incorporating an objective lens instead of an objective reflector.

The collimator or objective is shown in FIG. 4 as an offset reflector. Nevertheless, the collimator could equally be a lens 53, as shown in FIG. 5. Such a lens would be more appropriate for high millimeter wave frequencies (EHF), where the apertures need not be large, and the lens weight would not be excessive.

I claim:

1. A multiple beam antenna system comprising:

a beam forming network including a plurality of feed horns in a feed horn cluster;

an objective;

an imaging lens having a lateral magnification less than unity for focusing at a predetermined point in space a reduced image of said feed horn cluster;

a field lens positioned at said predetermined point in space;

an amplitude shaping lens positioned between said field lens and said objective, said amplitude shaping lens having an amplitude shaping refractive surface for creating a desired ray bunching distribution at the objective.

2. The multiple beam antenna of claim 1, wherein a refractive surface of said amplitude shaping lens is so formed that the rays of the image transmitted by said field lens are denser in a central region of said objective.

3. The multiple beam antenna system of claim 1, wherein said amplitude shaping lens creates a nonuniform power density distribution on said objective.

4. The multiple beam antenna system of claim 3, wherein said objective, said imaging lens, said field lens, and said amplitude shaping lens are positioned along a system axis, and wherein said amplitude shaping lens alters the amplitude distribution of the beams to converge the power density toward the lens axis.

5. The multiple beam antenna of claim 4, wherein said objective comprises an offset paraboloid reflector.

6. The multiple beam antenna of claim 4, wherein said objective comprises a objective lens.

7. A multiple beam antenna system comprising:

a beam forming network including a plurality of feed horns in a feed horn cluster;

an objective having a central region;

an imaging lens having a lateral image magnification factor less than unity for focusing at a predetermined point in space a reduced image of said feed horn cluster;

a field lens positioned at said predetermined point in space;

an amplitude shaping lens positioned between said field lens and said objective for focusing the rays of the image transmitted by said field lens to be denser in the central region of said objective and reduce the sidelobes in the far field pattern of the transmitted image.

8. The multiple beam antenna of claim 7, wherein said objective comprises an offset paraboloid reflector.

9. The multiple beam antenna of claim 7, wherein said objective comprises an objective lens.

* * * * *